US005942146A

United States Patent [19]

Blaker et al.

[11] Patent Number: 5,942,146

[45] Date of Patent: Aug. 24, 1999

[54] DIELECTRIC DRYING KILN ELECTRODE CONNECTOR

[75] Inventors: Glenn Craig Blaker, North Vancouver; Terry Albert Enegren, Vancouver, both of Canada

[73] Assignee: HeatWave Drying Systems Ltd., Castlegar, Canada

[21] Appl. No.: 09/161,295

[22] Filed: Sep. 28, 1998

[51] Int. Cl.[6] ..... H05B 6/54

[52] U.S. Cl. ..... 219/770; 219/775; 219/778; 219/780; 34/250; 34/257; 439/775

[58] Field of Search ..... 219/780, 778, 219/775, 774, 773, 776, 770, 764; 34/250, 255, 257; 439/775, 780

[56] References Cited

U.S. PATENT DOCUMENTS

| | | | |
|---|---|---|---|
| 2,474,420 | 6/1949 | Himmel | 219/778 |
| 2,474,517 | 6/1949 | Daum et al. | 219/780 |
| 2,530,680 | 11/1950 | Burkholder | 219/775 |
| 2,712,713 | 7/1955 | Jonas | 219/775 |
| 3,986,261 | 10/1976 | Koppelman . | |
| 4,472,618 | 9/1984 | Cloer . | |
| 5,065,299 | 11/1991 | Cohen | 362/431 |

*Primary Examiner*—Philip H. Leung
*Attorney, Agent, or Firm*—C. A. Rowley

[57] ABSTRACT

A dielectric drying kiln having a moveable electrode permanently electrically connected with a source of power via an electrical connector formed by a plurality of discrete interconnected electrically and mechanically interconnected conducting element that permit relative movement between the elements. One end of the electrical connector is connected to the moveable electrode and moveable therewith while said electrical connector maintains electrical connection with the source. The electrical connector has a minimum curvature on its outside surface having a radius of at least r to prevent arcing.

10 Claims, 3 Drawing Sheets

DIELECTRIC DRYING KILN ELECTRODE CONNECTOR

FIELD OF INVENTION

The present invention relates to an improved dielectric drying kiln electrode connector; more particularly, the present invention provides an electrode connector that allows automated computer control of the load handling cycle.

BACKGROUND OF THE INVENTION

Dielectric heating/drying systems are known and are currently in use or have been proposed for use in agriculture, polymer manufacture, pharmaceuticals, bulk powder, food processing, wood products, and other industries. One of the key industries using these dielectric heating/drying systems is the wood products industry and the present invention will be described particularly with respect to the wood products industry although the invention, with suitable modifications where required, may be applied in the other industries in which dielectric heating/drying is to be performed.

In dielectric drying systems (particularly those for drying wood of the type described in U.S. Pat. No. 3,986,268 issued Oct. 19, 1976 to Koppelman), it is conventional practice for the lumber to be moved into the drying chamber, at least one power electrode that will emit electromagnetic energy and a grounding electrode to complete the circuit are positioned near or in contact with the load. After the load has been positioned in the kiln these power and grounding electrodes are connected electrically to the source and ground respectively and then the kiln chamber may be closed and the drying process may commenced. This original material handling system, though adequate for many applications, does not lend itself to rapid loading and unloading nor does it facilitate automatic handling or operation of the kiln.

As above indicated, this original method requires manually connecting the radio-frequency (RF) generator to one or more electrodes before the drying cycle may be started and disconnecting the RF generator from the electrode(s) after drying and before the load may be removed from the kiln. This loading and unloading, connecting and disconnecting etc., necessitates the use of professionally trained personnel both for safety and operating procedures to better ensure there are no major problems or accidents. These limitations imposed by the use of the original type of connecting straps have given the process of dielectric drying a reputation of being non-robust in that it requires flimsy attachments which lead those in the lumber industry to imply that the technique is still in the research and experimental stage and has not yet been developed for commercial industrial purposes. In this original design, wide conductive straps (generally made of copper or aluminum with aluminum being the preferred material in most applications) are typically used. There are two further weaknesses with this approach. Firstly (and as often encountered in these types of systems), the sharp edges of these conductive straps create a high risk of catastrophic arcing due to a phenomenon known as electric field breakdown. (1/32" thick straps will at best have radiused edges of 1/64" but typically, a much smaller radius.) Secondly, it is preferred that all connection cables within a process of this type have low inductance (meaning wide thickness and short length if conductive straps are used). Therefore, if such conventional electrode straps are used and remain connected to a movable electrode, it is clear that longer (and flexible) straps will be required. Longer straps increase the inductance of the straps creating higher voltage drops across the straps resulting in higher risks of catastrophic arcing due to electric field breakdown.

BRIEF DESCRIPTION OF THE PRESENT INVENTION

It is an object of the present invention to provide an improved dielectric drying kiln electrode connector to replace known methods of connection.

It is a further object of the present invention to provide an electrode connector that permits automated loading and unloading in a cost-effective manner.

Broadly, the present invention relates to a dielectric drying kiln having a moveable electrode, an electrical connector connecting said moveable electrode with a source of power, said electrical connector having a plurality of discrete conducting elements, connecting means interconnecting said elements electrically while permitting relative movement between said elements, one end of said electrical connector connected to said moveable electrode and moveable therewith while said electrical connector maintains electrical connection with said source, the electrical connector will have a minimum curvature on its outside surface having a radius of at least r to prevent arcing of the connector.

Preferably r is $$r>=\tfrac{1}{5}\{[(E_{BD})(D)/V_{MAX}]-22\}$$

Where r and D are in centimeters (cm)

$V_{MAX}$ is in volts $E_{BD}$ is in volts/cm

Preferably said connecting means comprises an articulating connection between adjacent of said elements.

Preferably said connecting means comprises a sliding connection between adjacent of said elements Preferably said connecting means comprises a telescoping connection between adjacent of said elements.

Preferably said connecting means comprises a pivoting connection between adjacent of said elements Preferably, said kiln is provided with vacuum generating means for reducing the pressure in said kiln during said drying to a pressure below atmospheric pressure.

BRIEF DESCRIPTION OF THE DRAWINGS

Further features objects and advantages will be evident for the following detailed description taken in conjunction with the accompanying drawings in which.

DESCRIPTION OF THE PREFERRED EMBODIMENTS

Figure 1:
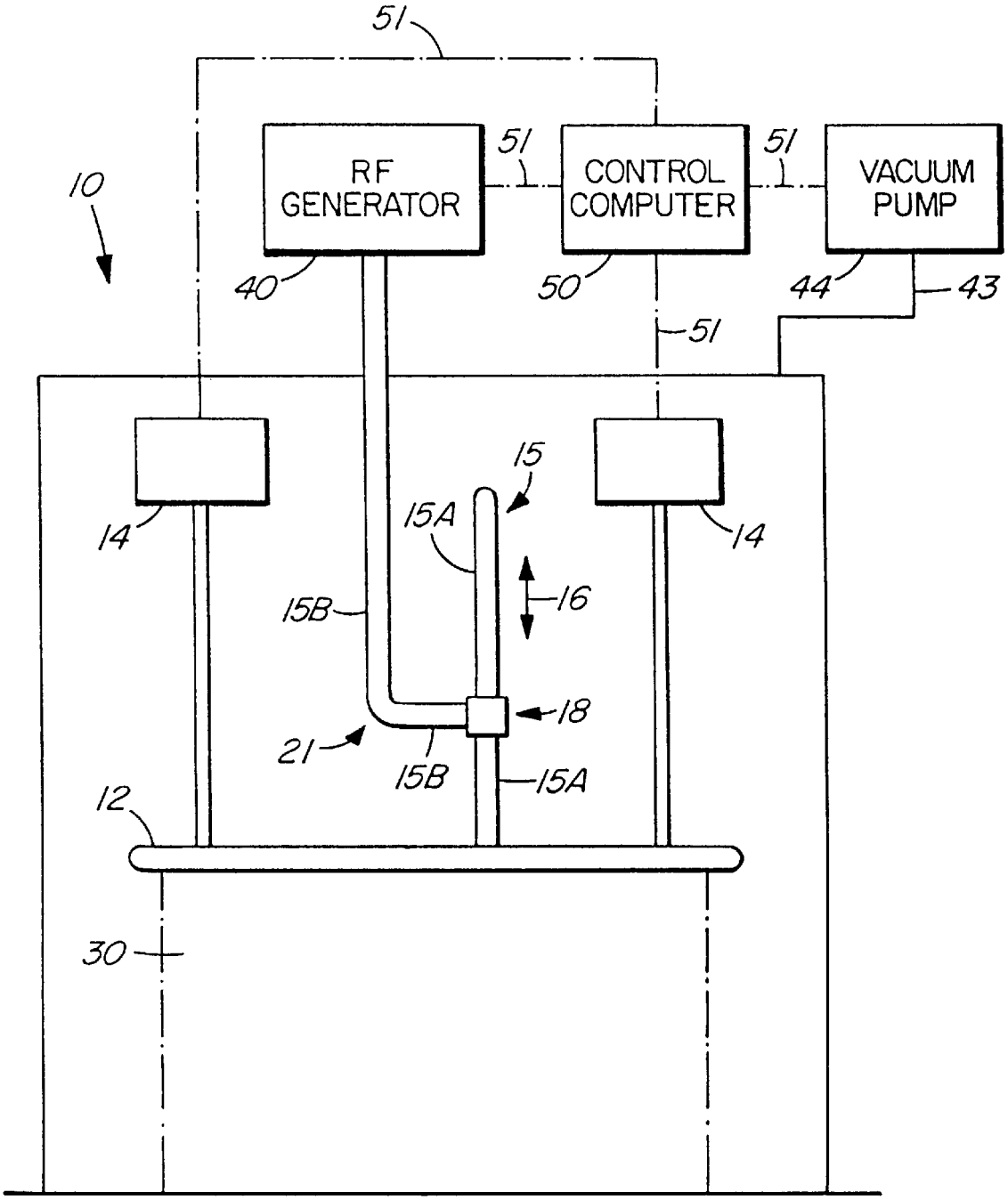
FIG. 1 is a schematic illustration of one embodiment of the present invention employing a single sliding joint is used.

The present invention is applied to a dielectric type kiln 10 having a moveable top electrode 12. The top electrode 12 is movable as indicated by the arrow 16 preferably by suitable hydraulic means or the like 14 (other means such as mechanical or pneumatic means may be used in place of the hydraulic means) to an operative drying/heating position wherein the top electrode is resting on top of or applying pressure to the top of the load (schematically indicated by the dotted lines 30)

Power is supplied to the load 30 preferably by a radio-frequency (RF) generation source as schematically represented at 40. In the preferred arrangement as illustrated, RF power is applied to the top electrode 12 through a matching network (not shown) which then applies the electromagnetic energy to the material between the electrodes such as the load of lumber schematically represented by the dotted line in FIGS. 1 and 3 indicated at 30.

It is also preferred that the kiln 10 be a vacuum-type kiln 10 and thus, the interior of the kiln 10 is connected as indicated by the line 42 to a vacuum pump or the like 44 that produces negative pressure, i.e. pressure below atmospheric within the interior of the kiln 10 at the appropriate time and when the kiln is sealed by known means.

Figure 3:
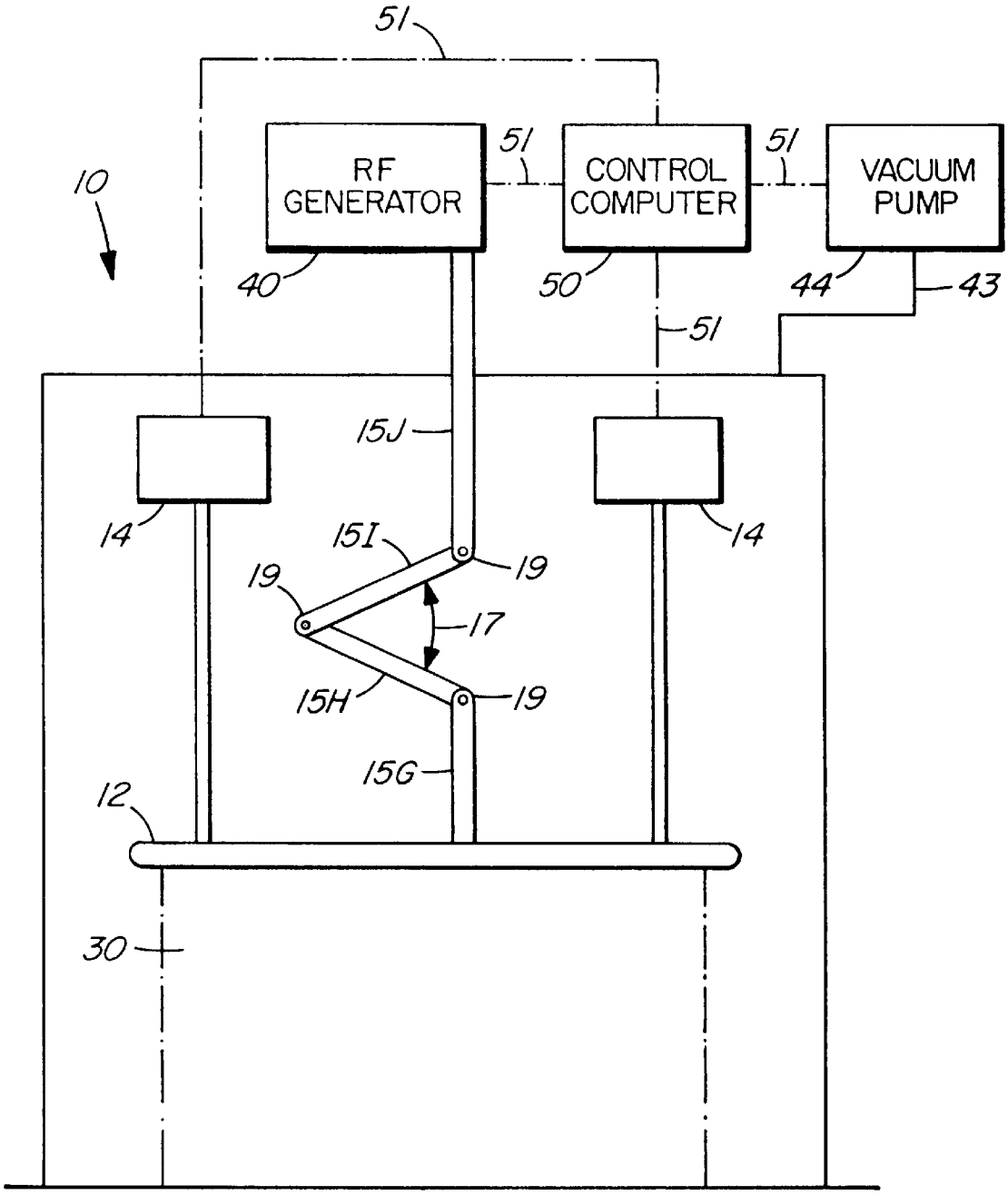
FIG. 3 is a schematic illustration of a third embodiment of the present invention using multiple hinged joints.

The signals governing the operation of the system are delivered between the various operating elements and control computer or the like 50 via control lines as indicated as dot-dash lines 51 in FIGS. 1 and 3.

A first embodiment of the electrode connector 15 is shown if FIG. 1 with a single electrically conductive sliding joint 18 joining solid electrically conductive sections or elements 15A and 15B preferably constructed of aluminum which form the connector 15 in this embodiment. One of the elements 15A is connected to the electrode 12 while the element 15B is connected to the power source 40. The two discrete elements are electrically interconnect by the sliding connection 18 formed by the element 15A passing through an passage formed at the free end of the element 15B. The interaction in the joint or sliding connection 18 maintains the electrical connection between the elements 15A and 15B while permitting relative movement therebetween so that the electrical connection from the source to the electrode is maintained when the electrode is in a lowered or extended position i.e. operative position against the top of the load 30.

Figure 2:
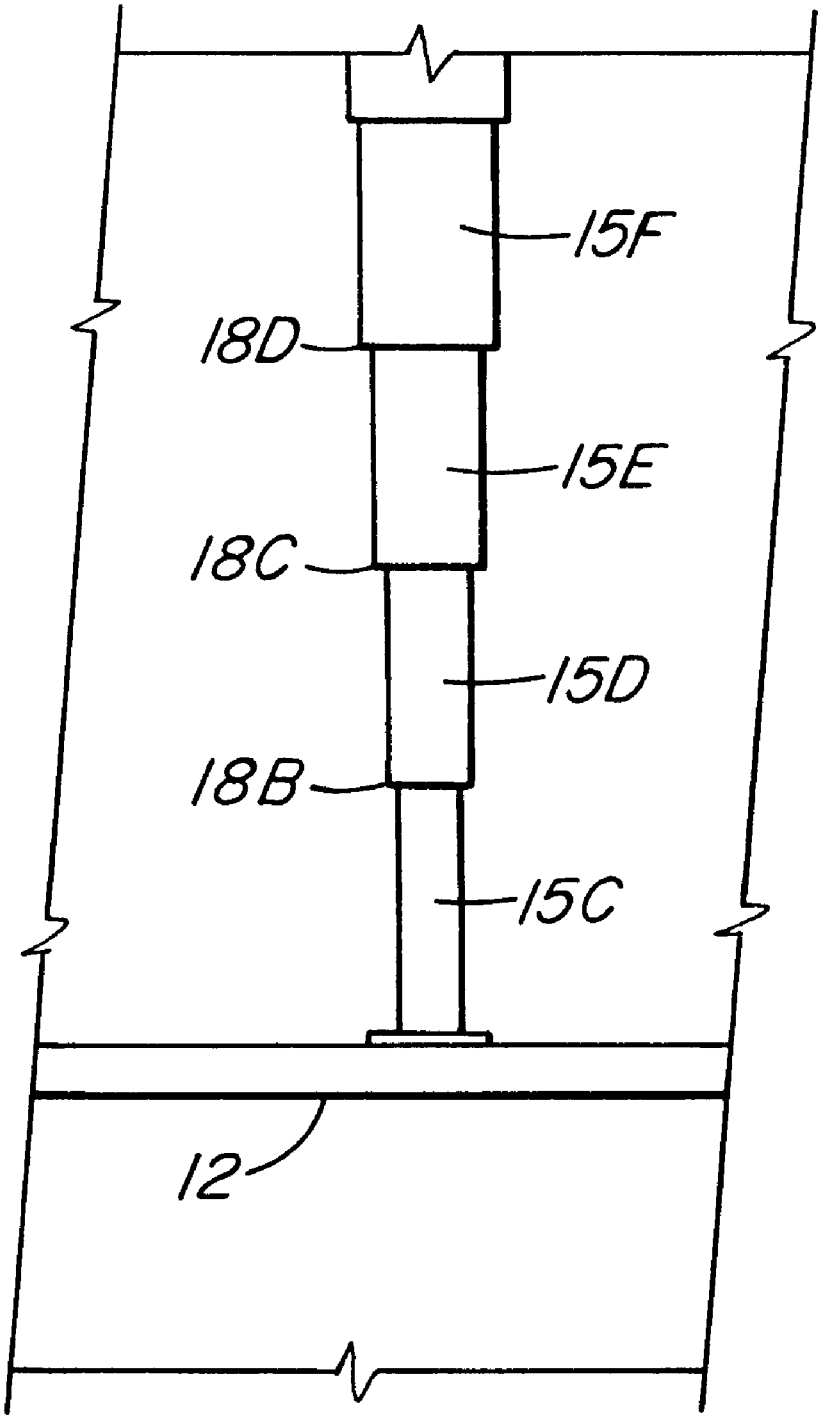
FIG. 2 is a schematic illustration of a second embodiment of the invention using multiple sliding joints.

In the arrangement shown in FIG. 2, the connector 15 is formed using multiple electrically conductive telescoping, sliding joints 18B, 18C and 18D one between and connecting each of the adjacent conducting elements 15C, 15D 15E and 15F to electrically interconnect the elements while permitting axial relative movement so that the electrical connector formed by the joints 18B, 18C and 18D and adjacent elements 15C, 15D 15E and 15F may be extended and retracted in a telescoping manner to permit movement of the electrode 12 to which element 15C is connected. This arrangement reduces the required space above the electrode 12. Preferably the electrode elements are made of aluminum.

In the arrangement shown in FIG. 3, the connector 15 is formed using multiple electrically conductive hinged joints 19, preferably made of aluminum, to join solid electrically conductive sections 15G, 15H, 15I and 15J, also preferably made of aluminum. If desired, suitable electrically conductive ball joints (not shown) could be used in place of the hinged joints.

If desired the connection between the connector 15 and the top electrode 12 in any of the above embodiments may be via an electrically conductive universal joint type connection.

In all of the embodiments it is extremely important that electrical arcing be prevented. This is attained in all cases by making all exposed outside surfaces of the connector 15 with a minimum radius r i.e. all edges of the conductive material of the connectors 15 must be filleted with a radius r sufficiently large to prevent electric field breakdown ($E_{BD}$). For example, the diameter of the elements 15A and 15B must be at least 2r, the curvature of the outside of the elbow 16 (FIG. 1) must have a curvature with a radius of at least r as must the outside of the coupling 18 (which inherently will be greater than 15,A). In the FIG. 2 embodiment all of the telescoping sections 15C, 15D, 15E and 15F must have outside diameters of at least 2r. In the embodiment of FIG. 3 all of the elements 15G, 15K, 15I and 15J must have outside diameters of at least 2r and the outsides of joints 19 all must have curvature with radiuses of at least r.

At the frequencies normally used for lumber drying $E_{BD}$ commences to occur at approximately 10,000 Volts/cm (V/cm) with ideal clean, dry high vacuum conditions and may be reduced by 50% with less than ideal conditions typically seen.

It is possible, knowing the conditions to be applied, to determine the maximum voltage level ($V_{MAX}$) that the top electrode 12 will encounter. This information permits determining the applied electric field between the electrodes 12 and 14 which is a function of $V_{MAX}$ and the separation (D) between the electrodes 12 and 14.

Generally, the minimum radius r will be at least $$r>=\tfrac{1}{5}\{[(E_{BD})(D)/V_{MAX}]-22\}$$

Where r and D are in centimeters (cm)

$V_{MAX}$ is in volts $E_{BD}$ is in volts/cm

Generally this means that for typical higher power applications seen in lumber drying implementations the minimum radius r will be greater than 0.035 cm and r will normally be set significantly larger than 0.035 cm to provide a better factor of safety.

Having described this invention, modifications will be evident to those skilled in the art without departing from the scope of the invention as defined in the appended claims.

We claim:

1. A dielectric drying kiln having a moveable electrode, an electrical connector substantially permanently connecting said moveable electrode with a source of power, said electrical connector having a plurality of discrete conducting elements, connecting means interconnecting adjacent said elements electrically while permitting relative movement between said elements, one end of said electrical connector connected to said moveable electrode and moveable therewith while said electrical connector maintains electrical connection with said source, said electrical connector has a minimum curvature on its outside surface having a radius of at least r to prevent electrical arcing of said electrical connector, wherein r is $$r>=\tfrac{1}{5}\{[(E_{BD})(D)/V_{MAX}]-22\}$$

Where r and D are in centimeters (cm)

$V_{MAX}$ is in volts $E_{BD}$ is in volts/cm.

2. A dielectric drying kiln as defined in claim 1 wherein said connecting means comprises an articulating connection between adjacent of said elements.

3. A dielectric drying kiln as defined in claim 2 wherein said kiln is provided with vacuum generating means for reducing the pressure in said kiln to a pressure below atmospheric pressure during said drying.

4. A dielectric drying kiln as defined in claim 1 wherein said connecting means comprises a sliding connection between adjacent of said elements.

5. A dielectric drying kiln as defined in claim 4 wherein said kiln is provided with vacuum generating means for reducing the pressure in said kiln to a pressure below atmospheric pressure during said drying.

6. A dielectric drying kiln as defined in claim 1 wherein said connecting means comprises a telescoping connection between adjacent of said elements.

7. A dielectric drying kiln as defined in claim 6 wherein said kiln is provided with vacuum generating means for reducing the pressure in said kiln to a pressure below atmospheric pressure during said drying.

8. A dielectric drying kiln as defined in claim 1 wherein said connecting means comprises a pivoting connection between adjacent of said elements.

9. A dielectric drying kiln as defined in claim 8 wherein said kiln is provided with vacuum generating means for reducing the pressure in said kiln to a pressure below atmospheric pressure during said drying.

10. A dielectric drying kiln as defined in claim 1 wherein said kiln is provided with vacuum generating means for reducing the pressure in said kiln to a pressure below atmospheric pressure during said drying.

* * * * *

UNITED STATES PATENT AND TRADEMARK OFFICE

CERTIFICATE OF CORRECTION

PATENT NO. : 5,942,146
DATED : August 24, 1999
INVENTOR(S) : Blaker et al.

It is certified that error appears in the above-identified patent and that said Letters Patent is hereby corrected as shown below:

Column 2,
Line 28, the formula reading
"$r>=1/5\{[(E_{BD})(D)V_{MAX}]-22\}$" should read -- $r>=1/\{5[(E_{BD})(D)/V_{MAX}]-22\}$ --

Column 4,
Lines 27 and 55, the formula reading
"$r>=1/5\{[(E_{BD})(D)V_{MAX}]-22\}$" should read -- $r>=1/\{5[(E_{BD})(D)/V_{MAX}]-22\}$ --

Signed and Sealed this

Twenty-eighth Day of September, 2004

JON W. DUDAS
*Director of the United States Patent and Trademark Office*